US010636376B2

(12) United States Patent
Guan

(10) Patent No.: US 10,636,376 B2
(45) Date of Patent: Apr. 28, 2020

(54) GOA CIRCUIT FOR SCAN ENHANCING

(71) Applicant: Wuhan China Star Optoelectronics Technology Co., Ltd., Wuhan, Hubei (CN)

(72) Inventor: Yanqing Guan, Hubei (CN)

(73) Assignee: WUHAN CHINA STAR OPTOELECTRONICS TECHNOLOGY CO., LTD., Wuhan (CN)

( * ) Notice: Subject to any disclaimer, the term of this patent is extended or adjusted under 35 U.S.C. 154(b) by 296 days.

(21) Appl. No.: 15/747,401

(22) PCT Filed: Nov. 30, 2017

(86) PCT No.: PCT/CN2017/113733
§ 371 (c)(1),
(2) Date: Jan. 24, 2018

(87) PCT Pub. No.: WO2019/095436
PCT Pub. Date: May 23, 2019

(65) Prior Publication Data

US 2020/0082777 A1 Mar. 12, 2020

(30) Foreign Application Priority Data

Nov. 17, 2017 (CN) ..... 2017 1 1147117

(51) Int. Cl.
*G09G 3/36* (2006.01)

(52) U.S. Cl.
CPC ..... *G09G 3/3677* (2013.01); *G09G 2330/027* (2013.01)

(58) Field of Classification Search
CPC ..... G09G 2330/027
See application file for complete search history.

(56) References Cited

U.S. PATENT DOCUMENTS

2006/0017681 A1* 1/2006 Jang ..... H01L 27/124 345/98

FOREIGN PATENT DOCUMENTS

CN 105206237 12/2015
CN 105469766 4/2016

* cited by examiner

*Primary Examiner* — Gustavo Polo
(74) *Attorney, Agent, or Firm* — Hemisphere Law, PLLC; Zhigang Ma

(57) ABSTRACT

A GOA circuit comprises m cascaded GOA units, wherein a $n^{th}$-stage GOA unit comprises: an output control module, a forward-reverse scan control module, a first pull-down circuit, a second pull-down circuit and a pull-up circuit, the forward-reverse scan control module is used for controlling the GOA circuit to perform a forward scanning or a reverse scanning; the output control module outputs a $n^{th}$ gate driving signal; the first pull-down circuit comprises a seventh TFT; the second pull-down circuit comprises a third TFT, a fourth TFT and a fifth TFT; and the pull-up circuit comprises an eighth TFT and a thirteenth TFT. After power of the liquid crystal display panel is turned off, the fifth TFT is turned off by overlapping of the forward scan control signal and the reverse scan control signal and a first global control signal is high potential.

16 Claims, 2 Drawing Sheets

GOA CIRCUIT FOR SCAN ENHANCING

RELATED APPLICATIONS

The present application is a National Phase of International Application Number PCT/CN2017/113733, filed on Nov. 30, 2017, and claims the priority of China Application No. 201711147117.2, filed on Nov. 17, 2017.

FIELD OF THE DISCLOSURE

The disclosure relates to a display technical field, and more particularly to a GOA circuit.

BACKGROUND

Currently, the liquid crystal display device has been widely used as a display component of electronic devices in various electronic products. The GOA (Gate Driver On Array) circuit is an important part of a liquid crystal display device. The GOA circuit is a technique using the existed process of manufacturing thin film transistor liquid crystal display array to manufacture a gate line scan driving signal circuit on an array substrate to realize a driving method scanning each gate line in sequence.

In accordance with TFT (Thin Film Transistor) type used in a display panel, the display panel based on LTPS (Low Temperature Poly-silicon) technique could be divided into NMOS type panel, PMOS type panel and CMOS type panel having both NMOS type and PMOS type. Similarly, the GOA circuit is divided into NMOS circuit, PMOS circuit and CMOS circuit. Comparing with the CMOS circuit, the NMOS circuit is helpful in increasing yield rate and decreasing cost because masks and procedures for manufacturing a PP (P doping, or Phosphorus ion doping) layer could be saved. Therefore, development of a stable NMOS circuit is a realistic need of this industry. When power is turned off abnormally and the NMOS type GOA circuit cannot effectively achieve the function of All Gate ON (that is, setting all the gate driving signals in the GOA circuit to be enabled to simultaneously scan the liquid crystal display panel), image sticking occurs on the display panel.

Taking forward scanning as an example and assuming that the $(n+1)^{th}$ clock signal received by the TFT NT3 is at high potential at the time when abnormal power off occurs in the GOA circuit shown in FIG. 1, the forward scan control signal and the $(n+1)^{th}$ clock signal are simultaneously pulled down to a low potential so that the high potential at the gate of the TFT NT5 cannot be released and therefore the TFT NT5 is kept at turned-on status. At the same time, the TFT NT8 is also in the turned-on status so that the gate of the TFT NT7 cannot be fully pulled down due to overlapping of the high potential signal VGH and the low potential signal VGL. Therefore, the gate driving signal G(n) output from the TFT NT7 to the TFT of the pixel unit is pulled down and is not enough for turning on the TFT of the pixel unit. Accordingly, the charges in the pixel electrode cannot be released in time, and image sticking in the effective displaying area is therefore generated due to abnormal power off.

SUMMARY

In order to solve problems of the technique mentioned above, the present invention provides a GOA circuit for eliminating image sticking generated when power of the liquid crystal display panel is turned off abnormally to improve user experiences.

The present invention provides a GOA circuit, which is used in a liquid crystal display panel, comprising m cascaded GOA units, wherein a $n^{th}$-stage GOA unit comprises: an output control module, a forward-reverse scan control module, a first pull-down circuit, a second pull-down circuit and a pull-up circuit, wherein $m \geq n \geq 1$;

the forward-reverse scan control module is used for controlling the GOA circuit to perform a forward scanning or a reverse scanning in accordance with a forward scan control signal or a reverse scan control signal;

the output control module is connected to the forward-reverse scan control module to output a $n^{th}$ gate driving signal in a duration performing the forward scanning or the reverse scanning by the GOA circuit;

the first pull-down circuit comprises a seventh TFT, a first terminal of the seventh TFT is connected to the output control module, and a second terminal of the seventh TFT receives a low potential signal;

the second pull-down circuit comprises a third TFT, a fourth TFT and a fifth TFT, a first terminal of the third TFT receives the forward scan control signal, a first terminal of the fourth TFT receives the reverse scan control signal, a second terminal of the third TFT and a second terminal of the fourth TFT are connected to a third terminal of the fifth TFT, a third terminal of the third TFT and a third terminal of the fourth TFT receive a clock signal, respectively, and the clock signal turns on the third TFT and the fourth TFT after power of the liquid crystal display panel is turned off;

a first terminal of the fifth TFT receives a high potential signal, and a second terminal of the fifth TFT is connected to a third terminal of the seventh TFT;

the pull-up circuit comprises an eighth TFT and a thirteenth TFT, a first terminal of the eighth TFT is connected to the third terminal of the seventh TFT, a second terminal of the eighth TFT receives the low potential signal, and a third terminal of the eighth TFT receives a first global control signal;

a first terminal and a third terminal of the thirteenth TFT are both connected to the third terminal of the eighth TFT, a second terminal of the thirteenth TFT is connected to the first terminal of the seventh TFT;

wherein, the first terminal is one of source and drain, the second terminal is another one of source and drain, the third terminal is gate, and, after power of the liquid crystal display panel is turned off, the forward scan control signal and the reverse scan control signal are both low potential and the first global control signal is high potential.

Preferably, the GOA unit further comprises a voltage stabilizing circuit;

the voltage stabilizing circuit comprises a ninth TFT, and the output control module comprises a sixth TFT;

a third terminal of the ninth TFT receives the high potential signal, a second terminal of the ninth TFT is connected to a third terminal of the sixth TFT, a first terminal of the ninth TFT is connected to the forward-reverse scan control module;

a first terminal of the sixth TFT receives a $n^{th}$ clock signal, a second terminal of the sixth TFT is connected to the first terminal of the seventh TFT, and a point connecting the sixth TFT and the seventh TFT is used as an output terminal for outputting the $n^{th}$ gate driving signal.

Preferably, the forward-reverse scan control module comprises a first TFT and a second TFT;

a first terminal of the first TFT receives the forward scan control signal, and a second terminal of the first TFT is connected to the first terminal of the ninth TFT;

a first terminal of the second TFT receives the reverse scan control signal, and a second terminal of the second TFT is connected to the second terminal of the first TFT;

wherein, the third terminal of the first TFT receives a $(n-2)^{th}$ gate driving signal when $n>2$, and receives a scan start-up signal when $n\leq 2$;

the third terminal of the second TFT receives a $(n+2)^{th}$ gate driving signal when $n\leq m-2$, and receives the scan start-up signal when $n>m-2$;

the scan start-up signal is high potential after power of the liquid crystal display panel is turned off.

Preferably, the third terminal of the third TFT receives a $(n+1)^{th}$ clock signal, and the third terminal of the fourth TFT receives a $(n-1)^{th}$ clock signal.

Preferably, the GOA circuit comprises 4 clock signals comprising a first clock signal, a second clock signal, a third clock signal and a fourth clock signal, wherein, the $(n+1)^{th}$ clock signal is the first clock signal when the $n^{th}$ clock signal is the fourth clock signal, and the $(n-1)^{th}$ clock signal is the fourth clock signal when the $n^{th}$ clock signal is the first clock signal.

Preferably, the GOA unit further comprises a first capacitor, a second capacitor and a tenth TFT;

a third terminal of the tenth TFT is connected to the second terminal of the fifth TFT, a first terminal of the tenth TFT is connected to the first terminal of the ninth TFT and a second terminal of the tenth TFT receives the low potential signal;

one terminal of the first capacitor is connected to the first terminal of the ninth TFT and another terminal of the first capacitor receives the low potential signal;

one terminal of the second capacitor is connected to the third terminal of the seventh TFT and another terminal of the second capacitor is connected to the second terminal of the seventh TFT.

Preferably, the GOA unit further comprises a twelfth TFT and an eleventh TFT;

a third terminal of the twelfth TFT is connected to the second terminal of the first TFT and the second terminal of the second TFT, a second terminal of the twelfth TFT receives the low potential signal, and a first terminal of the twelfth TFT is connected to the third terminal of the seventh TFT;

a third terminal and a second terminal of the eleventh TFT are connected together to receive a reset signal, and a first terminal of the eleventh TFT is connected to the third terminal of the seventh TFT.

Preferably, all the TFT's in the GOA unit are N-channel TFT's.

Preferably, all the clock signals are high potential after power of the liquid crystal display panel is turned off.

The present invention further provides a GOA circuit, which is used in a liquid crystal display panel, comprising m cascaded GOA units, wherein a $n^{th}$-stage GOA unit comprises: an output control module, a forward-reverse scan control module, a first pull-down circuit, a second pull-down circuit and a pull-up circuit, wherein $m\geq n\geq 1$;

the forward-reverse scan control module is used for controlling the GOA circuit to perform a forward scanning or a reverse scanning in accordance with a forward scan control signal or a reverse scan control signal;

the output control module is connected to the forward-reverse scan control module to output a $n^{th}$ gate driving signal in a duration performing the forward scanning or the reverse scanning by the GOA circuit;

the first pull-down circuit comprises a seventh TFT, a first terminal of the seventh TFT is connected to the output control module, and a second terminal of the seventh TFT receives a low potential signal;

the second pull-down circuit comprises a third TFT, a fourth TFT and a fifth TFT, a first terminal of the third TFT receives the forward scan control signal, a first terminal of the fourth TFT receives the reverse scan control signal, a second terminal of the third TFT and a second terminal of the fourth TFT are connected to a third terminal of the fifth TFT, a third terminal of the third TFT and a third terminal of the fourth TFT receive a clock signal, respectively, and the clock signal turns on the third TFT and the fourth TFT after power of the liquid crystal display panel is turned off;

a first terminal of the fifth TFT receives a high potential signal, and a second terminal of the fifth TFT is connected to a third terminal of the seventh TFT;

the pull-up circuit comprises an eighth TFT and a thirteenth TFT, a first terminal of the eighth TFT is connected to the third terminal of the seventh TFT, a second terminal of the eighth TFT receives the low potential signal, and a third terminal of the eighth TFT receives a first global control signal;

a first terminal and a third terminal of the thirteenth TFT are both connected to the third terminal of the eighth TFT, a second terminal of the thirteenth TFT is connected to the first terminal of the seventh TFT;

the GOA unit further comprises a voltage stabilizing circuit;

the voltage stabilizing circuit comprises a ninth TFT, and the output control module comprises a sixth TFT;

a third terminal of the ninth TFT receives the high potential signal, a second terminal of the ninth TFT is connected to a third terminal of the sixth TFT, a first terminal of the ninth TFT is connected to the forward-reverse scan control module;

a first terminal of the sixth TFT receives a $n^{th}$ clock signal, a second terminal of the sixth TFT is connected to the first terminal of the seventh TFT, and a point connecting the sixth TFT and the seventh TFT is used as an output terminal for outputting the $n^{th}$ gate driving signal;

wherein, the first terminal is one of source and drain, the second terminal is another one of source and drain, the third terminal is gate, and, after power of the liquid crystal display panel is turned off, the forward scan control signal and the reverse scan control signal are both low potential and the first global control signal is high potential.

Preferably, the forward-reverse scan control module comprises a first TFT and a second TFT;

a first terminal of the first TFT receives the forward scan control signal, and a second terminal of the first TFT is connected to the first terminal of the ninth TFT;

a first terminal of the second TFT receives the reverse scan control signal, and a second terminal of the second TFT is connected to the second terminal of the first TFT;

wherein, the third terminal of the first TFT receives a $(n-2)^{th}$ gate driving signal when $n>2$, and receives a scan start-up signal when $n\leq 2$;

the third terminal of the second TFT receives a $(n+2)^{th}$ gate driving signal when $n \leq m-2$, and receives the scan start-up signal when $n > m-2$;

the scan start-up signal is high potential after power of the liquid crystal display panel is turned off.

Preferably, the third terminal of the third TFT receives a $(n+1)^{th}$ clock signal, and the third terminal of the fourth TFT receives a $(n-1)^{th}$ clock signal.

Preferably, the GOA circuit comprises 4 clock signals comprising a first clock signal, a second clock signal, a third clock signal and a fourth clock signal, wherein, the $(n+1)^{th}$ clock signal is the first clock signal when the $n^{th}$ clock signal is the fourth clock signal, and the $(n-1)^{th}$ clock signal is the fourth clock signal when the $n^{th}$ clock signal is the first clock signal.

Preferably, the GOA unit further comprises a first capacitor, a second capacitor and a tenth TFT;

a third terminal of the tenth TFT is connected to the second terminal of the fifth TFT, a first terminal of the tenth TFT is connected to the first terminal of the ninth TFT and a second terminal of the tenth TFT receives the low potential signal;

one terminal of the first capacitor is connected to the first terminal of the ninth TFT and another terminal of the first capacitor receives the low potential signal;

one terminal of the second capacitor is connected to the third terminal of the seventh TFT and another terminal of the second capacitor is connected to the second terminal of the seventh TFT.

Preferably, the GOA unit further comprises a twelfth TFT and an eleventh TFT;

a third terminal of the twelfth TFT is connected to the second terminal of the first TFT and the second terminal of the second TFT, a second terminal of the twelfth TFT receives the low potential signal, and a first terminal of the twelfth TFT is connected to the third terminal of the seventh TFT;

a third terminal and a second terminal of the eleventh TFT are connected together to receive a reset signal, and a first terminal of the eleventh TFT is connected to the third terminal of the seventh TFT.

Preferably, all the TFT's in the GOA unit are N-channel TFT's.

Preferably, all the clock signals are high potential after power of the liquid crystal display panel is turned off.

Benefits of the present invention are as follows: The fifth TFT NT5 is turned off by the forward scan control signal U2D and the reverse scan control signal D2U, the high potential signal VGH is prevented from flowing into the seventh TFT NT7, and the low potential signal VGL flows into the gate of the seventh TFT NT7 through the eighth TFT NT8 to turn off the seventh TFT NT7 to prevent the $n^{th}$ gate driving signal G(n) from being pulled down by the low potential signal VGL. At the same time, because the forward scan control signal U2D and the reverse scan control signal D2U are both low potential, the first global control signal GAS1 is set to be high potential to turn on the thirteenth TFT NT13 to pull up the $n^{th}$ gate driving signal G(n) so that the potential of the $n^{th}$ gate driving signal G(n) is prevented from being too low to effectively turn on the TFT of the pixel unit.

Therefore, the present application could fully turn on the pixels of the liquid crystal display panel so that the charges on the pixel electrodes could be released in time and conducted through the data lines of the liquid crystal display panel to eliminate image sticking generated when power of the liquid crystal display panel is turned off to improve user experiences.

BRIEF DESCRIPTION OF THE DRAWINGS

In order to make the descriptions of the technique solutions of the embodiments of the present invention or the existed techniques be clearer, the drawings necessary for describing the embodiments or the existed techniques are briefly introduced below. Obviously, the drawings described below are only some embodiments of the present invention, and, for those with ordinary skill in this field, other drawings can be obtained from the drawings described below without creative efforts.

DETAILED DESCRIPTION OF PREFERRED EMBODIMENTS

Figure 1:
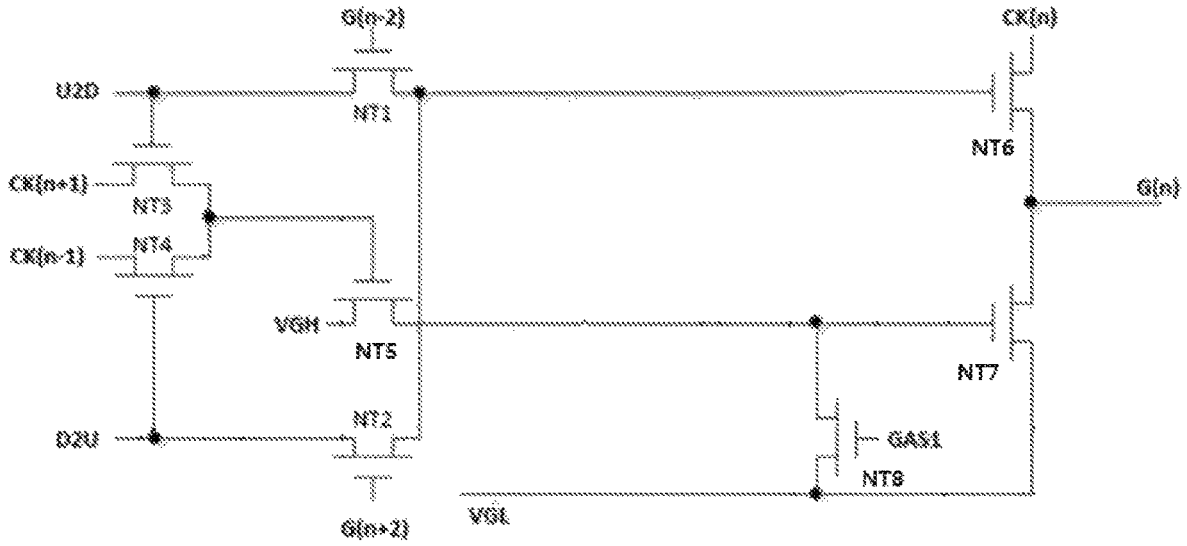
FIG. 1 is circuit diagram of the $n^{th}$-stage GOA unit of the GOA circuit in the background provided by the present disclosure.
Figure 2:
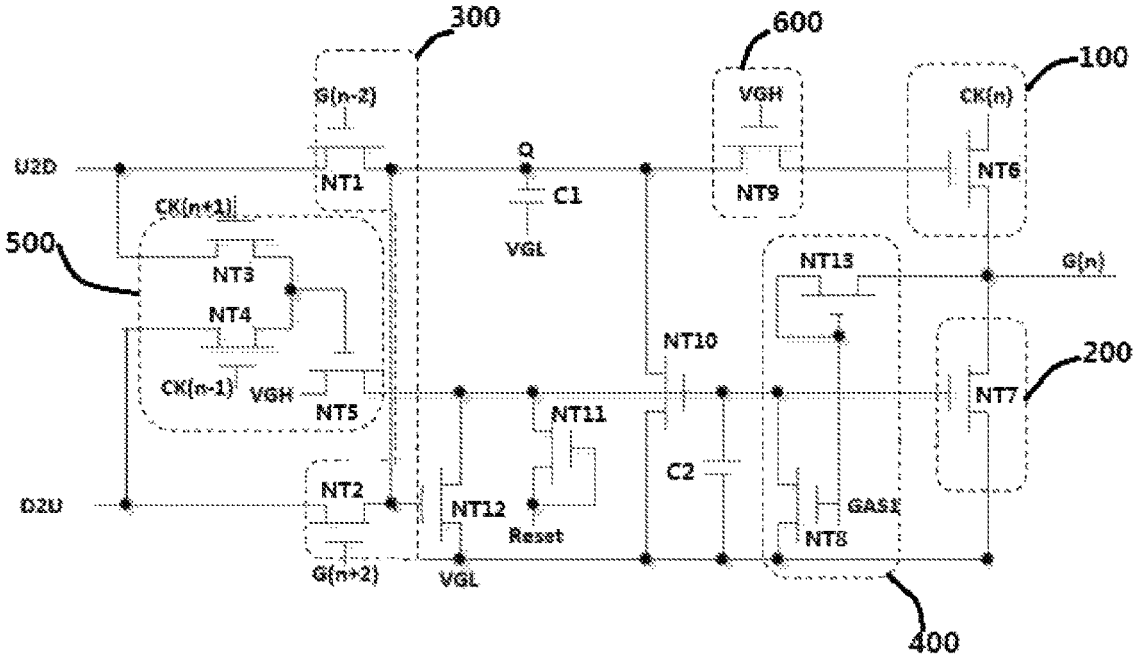
FIG. 2 is a circuit diagram of the $n^{th}$-stage GOA unit of the GOA circuit provided by the present invention.

The present invention provides a GOA circuit, which is used in a liquid crystal display panel. The GOA circuit comprises m cascaded GOA units. As shown in FIG. 2, a $n^{th}$-stage GOA unit comprises: an output control module 100, a forward-reverse scan control module 300, a first pull-down circuit 200, a second pull-down circuit 500 and a pull-up circuit 400, wherein $m \geq n \geq 1$.

The forward-reverse scan control module 300 is used for controlling the GOA circuit to perform a forward scanning or a reverse scanning in accordance with a forward scan control signal U2D or a reverse scan control signal D2U.

The output control module 100 is connected to the forward-reverse scan control module 300 to output a $n^{th}$ gate driving signal G(n) in a duration performing the forward scanning or the reverse scanning by the GOA circuit.

The first pull-down circuit 200 comprises a seventh TFT NT7, a first terminal of the seventh TFT NT7 is connected to the output control module 100, and a second terminal of the seventh TFT NT7 receives a low potential signal VGL.

The second pull-down circuit 500 comprises a third TFT NT3, a fourth TFT NT4 and a fifth TFT NTS. A first terminal of the third TFT NT3 receives the forward scan control signal U2D, a first terminal of the fourth TFT NT4 receives the reverse scan control signal D2U, a second terminal of the third TFT NT3 and a second terminal of the fourth TFT NT4 are connected to a third terminal of the fifth TFT NTS, a third terminal of the third TFT NT3 and a third terminal of the fourth TFT NT4 receive a clock signal, respectively, and the clock signals turn on the third TFT NT3 and the fourth TFT NT4 after power of the liquid crystal display panel is turned off.

A first terminal of the fifth TFT NT5 receives a high potential signal VGH, and a second terminal of the fifth TFT NT5 is connected to a third terminal of the seventh TFT NT7.

The pull-up circuit 400 comprises an eighth TFT NT8 and a thirteenth TFT NT13. A first terminal of the eighth TFT NT8 is connected to the third terminal of the seventh TFT NT7, a second terminal of the eighth TFT NT8 receives the low potential signal VGL, and a third terminal of the eighth TFT NT8 receives a first global control signal GAS1.

A first terminal and a third terminal of the thirteenth TFT NT13 are both connected to the third terminal of the eighth TFT NT8, and a second terminal of the thirteenth TFT NT13 is connected to the first terminal of the seventh TFT NT7.

Wherein, the first terminal is one of source and drain, the second terminal is another one of source and drain, the third terminal is gate, and, after power of the liquid crystal display panel is turned off, the forward scan control signal U2D and the reverse scan control signal D2U are both low potential and the first global control signal GAS1 is high potential.

Furthermore, the GOA unit further comprises a voltage stabilizing circuit 600. The voltage stabilizing circuit 600 comprises a ninth TFT NT9, and the output control module 100 comprises a sixth TFT NT6.

A third terminal of the ninth TFT NT9 receives the high potential signal VGH, a second terminal of the ninth TFT NT9 is connected to a third terminal of the sixth TFT NT6, and a first terminal of the ninth TFT NT9 is connected to the forward-reverse scan control module 300.

A first terminal of the sixth TFT NT6 receives a $n^{th}$ clock signal CK(n), a second terminal of the sixth TFT NT6 is connected to the first terminal of the seventh TFT NT7, and a point connecting the sixth TFT NT6 and the seventh TFT NT7 is used as an output terminal for outputting the $n^{th}$ gate driving signal G(n).

Furthermore, the forward-reverse scan control module 300 comprises a first TFT NT1 and a second TFT NT2.

A first terminal of the first TFT NT1 receives the forward scan control signal U2D, and a second terminal of the first TFT NT1 is connected to the first terminal of the ninth TFT NT9.

A first terminal of the second TFT NT2 receives the reverse scan control signal D2U, and a second terminal of the second TFT NT2 is connected to the second terminal of the first TFT NT1.

Wherein, the third terminal of the first TFT NT1 receives a $(n-2)^{th}$ gate driving signal G(n−2) when n>2, and receives a scan start-up signal when n≤2.

The third terminal of the second TFT NT2 receives a $(n+2)^{th}$ gate driving signal G(n+2) when n≤m−2, and receives the scan start-up signal when n>m−2.

The scan start-up signal is high potential after power of the liquid crystal display panel is turned off.

Furthermore, the third terminal of the third TFT NT3 receives a $(n+1)^{th}$ clock signal CK(n+1), and the third terminal of the fourth TFT NT4 receives a $(n-1)^{th}$ clock signal CK(n−1).

Furthermore, the GOA circuit comprises 4 clock signals comprising a first clock signal, a second clock signal, a third clock signal and a fourth clock signal. The $(n+1)^{th}$ clock signal CK(n+1) is the first clock signal when the $n^{th}$ clock signal CK(n) is the fourth clock signal, and the $(n-1)^{th}$ clock signal CK(n−1) is the fourth clock signal when the $n^{th}$ clock signal CK(n) is the first clock signal.

When the second pull-down 500 of the $n^{th}$-stage GOA unit receives the first clock signal and the third clock signal, the second pull-down 500 of the $(n+1)^{th}$-stage GOA unit would receive the second clock signal and the fourth clock signal. Therefore, the $n^{th}$-stage GOA unit and the $(n+1)^{th}$-stage GOA unit compose a GOA repeating unit.

Furthermore, the GOA unit further comprises a first capacitor, a second capacitor and a tenth TFT NT10.

A third terminal of the tenth TFT NT10 is connected to the second terminal of the fifth TFT NTS, a first terminal of the tenth TFT NT10 is connected to the first terminal of the ninth TFT NT9 and a second terminal of the tenth TFT NT10 receives the low potential signal VGL.

One terminal of the first capacitor is connected to the first terminal of the ninth TFT NT9 and another terminal of the first capacitor receives the low potential signal VGL.

One terminal of the second capacitor is connected to the third terminal of the seventh TFT NT7 and another terminal of the second capacitor is connected to the second terminal of the seventh TFT NT7.

Furthermore, the GOA unit further comprises a twelfth TFT NT12 and an eleventh TFT NT11.

A third terminal of the twelfth TFT NT12 is connected to the second terminal of the first TFT NT1 and the second terminal of the second TFT NT2, a second terminal of the twelfth TFT NT12 receives the low potential signal VGL, and a first terminal of the twelfth TFT NT12 is connected to the third terminal of the seventh TFT NT7.

A third terminal and a second terminal of the eleventh TFT NT11 are connected together to receive a reset signal Reset, and a first terminal of the eleventh TFT NT11 is connected to the third terminal of the seventh TFT NT7.

Furthermore, all the TFT's in the GOA unit are N-channel TFT's. Specifically, all the TFT's from the first TFT NT1 to the thirteenth TFT NT13 are N-channel TFT's.

Furthermore, all the clock signals are high potential after power of the liquid crystal display panel is turned off.

Figure 3:
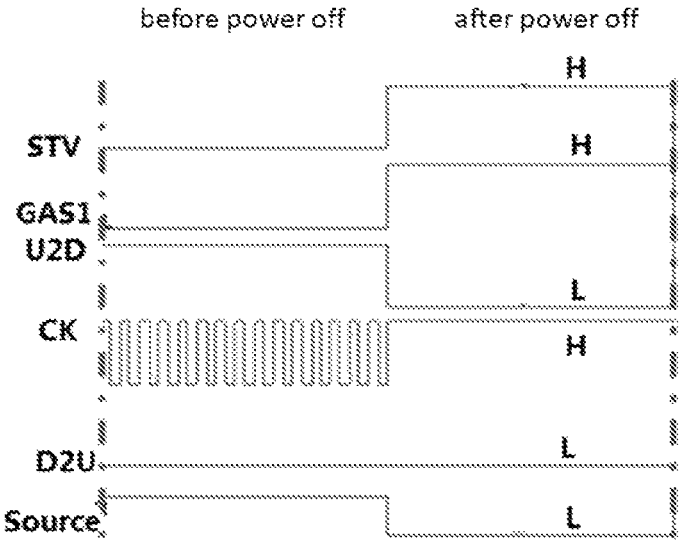
FIG. 3 is a timing diagram of the signals when power of the liquid crystal display panel is turned off in the disclosure provided by the present invention.

When power of the liquid crystal display panel is turned off, timings of the signals are shown in FIG. 3. The scan start-up signal STV, the first global control signal GAS1 and all the clock signals CK are high potential (H), and the forward scan control signal U2D and the reverse scan control signal D2U are low potential (L). The potential of the gate of the fifth TFT NT5 is obtained by overlapping the potential of the $(n+1)^{th}$ clock signal CK(n+1) and the potential of the $(n-1)^{th}$ clock signal CK(n−1) so that the gate of the fifth TFT NT5 is also low potential and the fifth TFT NT5 is turned off. In another aspect, the eighth TFT NT8 is turned on, and the low potential signal VGL flows into the gate of the seventh TFT NT7 to turn off the seventh TFT NT7. At the same time, the first global control signal GAS1 is set to high potential to turn on the thirteenth TFT NT13 so that the potential of the nth gate driving signal G(n) is pulled up after the thirteenth TFT NT13 is turned on. It also can be observed that the potential Source of the data line is changed to be low potential.

Figure 4:
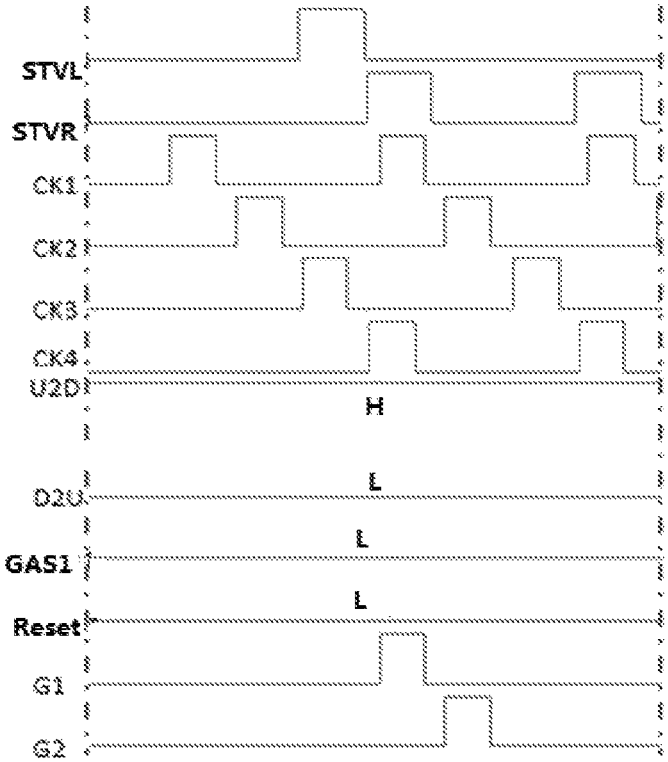
FIG. 4 is a timing diagram of the signals when the liquid crystal display panel displays normally in the disclosure provided by the present invention.

As shown in FIG. 4, the scan start-up signal received by the third terminals of the first TFT NT1 and the second TFT NT2 are the scan start-up signal STVL when the n mentioned above is an odd number, and the scan start-up signal received by the third terminals of the first TFT NT1 and the second TFT NT2 are the scan start-up signal STVR when the n mentioned above is an even number. Timings of the four clock signals CK1, CK2, CK3 and CK4 can be found in FIG. 4, wherein the forward scan control signal U2D is high potential (H) and the reverse scan control signal D2U is low potential (L), that is, in the forward scanning status. The first global control signal GAS1 and the reset signal Reset are both low potential, the gate driving signal G1 is output from the first-stage GOA unit, and the gate driving signal G2 is output from the second-stage GOA unit.

The GOA circuit in the present invention could utilize not only the forward scan status of the liquid crystal display panel (i.e., the forward scan control signal U2D is high potential and the reverse scan control signal U2D is low potential) but also the reverse scan status (i.e., the forward scan control signal U2D is low potential and the reverse scan control signal U2D is high potential), the TFT's of the pixel units could be turned on line-by-line, and the All Gate ON function could be achieved under the situation that the power of the liquid crystal display panel is turned off abnormally.

In summary, after power of the liquid crystal display panel is turned off, the fifth TFT NT5 is turned off by the forward scan control signal U2D and the reverse scan control signal D2U so that the high potential signal VGH is prevented from flowing into the seventh TFT NT7, and the low potential signal VGL flows into the gate of the seventh TFT NT7 through the eighth TFT NT8 to turn off the seventh TFT NT7 to prevent the nth gate driving signal G(n) from being pulled down by the low potential signal VGL. At the same time, because the forward scan control signal U2D and the reverse scan control signal D2U are both low potential, the first global control signal GAS1 is set to be high potential to turn on the thirteenth TFT NT13 to pull up the $n^{th}$ gate driving signal G(n) so that the potential of the $n^{th}$ gate driving signal G(n) is prevented from being too low to effectively turn on the TFT of the pixel unit.

Therefore, the present application could fully turn on the pixels of the liquid crystal display panel so that the charges on the pixel electrodes could be released in time and conducted through the data lines of the liquid crystal display panel to eliminate image sticking generated when power of the liquid crystal display panel is turned off, so that user experiences are improved.

The foregoing contents are detailed description of the disclosure in conjunction with specific preferred embodiments and concrete embodiments of the disclosure are not limited to these descriptions. For the person skilled in the art of the disclosure, without departing from the concept of the disclosure, simple deductions or substitutions can be made and should be included in the protection scope of the application.

What is claimed is:

1. A GOA circuit, which is used in a liquid crystal display panel, comprising m cascaded GOA units, wherein a $n^{th}$-stage GOA unit comprises: an output control module, a forward-reverse scan control module, a first pull-down circuit, a second pull-down circuit and a pull-up circuit, wherein $m \geq n \geq 1$;

the forward-reverse scan control module is used for controlling the GOA circuit to perform a forward scanning or a reverse scanning in accordance with a forward scan control signal or a reverse scan control signal;

the output control module is connected to the forward-reverse scan control module to output a $n^{th}$ gate driving signal in a duration performing the forward scanning or the reverse scanning by the GOA circuit;

the first pull-down circuit comprises a seventh TFT, a first terminal of the seventh TFT is connected to the output control module, and a second terminal of the seventh TFT receives a low potential signal;

the second pull-down circuit comprises a third TFT, a fourth TFT and a fifth TFT, a first terminal of the third TFT receives the forward scan control signal, a first terminal of the fourth TFT receives the reverse scan control signal, a second terminal of the third TFT and a second terminal of the fourth TFT are connected to a third terminal of the fifth TFT, a third terminal of the third TFT and a third terminal of the fourth TFT receive a clock signal, respectively, and the clock signal turns on the third TFT and the fourth TFT after power of the liquid crystal display panel is turned off;

a first terminal of the fifth TFT receives a high potential signal, and a second terminal of the fifth TFT is connected to a third terminal of the seventh TFT;

the pull-up circuit comprises an eighth TFT and a thirteenth TFT, a first terminal of the eighth TFT is connected to the third terminal of the seventh TFT, a second terminal of the eighth TFT receives the low potential signal, and a third terminal of the eighth TFT receives a first global control signal;

a first terminal and a third terminal of the thirteenth TFT are both connected to the third terminal of the eighth TFT, a second terminal of the thirteenth TFT is connected to the first terminal of the seventh TFT;

wherein, the first terminal is one of source and drain, the second terminal is another one of source and drain, the third terminal is gate, and, after power of the liquid crystal display panel is turned off, the forward scan control signal and the reverse scan control signal are both low potential and the first global control signal is high potential.

2. The GOA circuit according to claim 1, wherein the GOA unit further comprises a voltage stabilizing circuit;

the voltage stabilizing circuit comprises a ninth TFT, and the output control module comprises a sixth TFT;

a third terminal of the ninth TFT receives the high potential signal, a second terminal of the ninth TFT is connected to a third terminal of the sixth TFT, a first terminal of the ninth TFT is connected to the forward-reverse scan control module;

a first terminal of the sixth TFT receives a nth clock signal, a second terminal of the sixth TFT is connected to the first terminal of the seventh TFT, and a point connecting the sixth TFT and the seventh TFT is used as an output terminal for outputting the nth gate driving signal.

3. The GOA circuit according to claim 2, wherein the forward-reverse scan control module comprises a first TFT and a second TFT;

a first terminal of the first TFT receives the forward scan control signal, and a second terminal of the first TFT is connected to the first terminal of the ninth TFT;

a first terminal of the second TFT receives the reverse scan control signal, and a second terminal of the second TFT is connected to the second terminal of the first TFT;

wherein, the third terminal of the first TFT receives a $(n-2)^{th}$ gate driving signal when $n>2$, and receives a scan start-up signal when $n \leq 2$;

the third terminal of the second TFT receives a $(n+2)^{th}$ gate driving signal when $n \leq m-2$, and receives the scan start-up signal when $n>m-2$;

the scan start-up signal is high potential after power of the liquid crystal display panel is turned off.

4. The GOA circuit according to claim 1, wherein the third terminal of the third TFT receives a $(n+1)^{th}$ clock signal, and the third terminal of the fourth TFT receives a $(n-1)^{th}$ clock signal.

5. The GOA circuit according to claim 4, wherein, the GOA circuit comprises 4 clock signals comprising a first clock signal, a second clock signal, a third clock signal and a fourth clock signal, wherein, the $(n+1)^{th}$ clock signal is the first clock signal when the $n^{th}$ clock signal is the fourth clock signal, and the $(n-1)^{th}$ clock signal is the fourth clock signal when the $n^{th}$ clock signal is the first clock signal.

6. The GOA circuit according to claim 2, wherein the GOA unit further comprises a first capacitor, a second capacitor and a tenth TFT;

a third terminal of the tenth TFT is connected to the second terminal of the fifth TFT, a first terminal of the tenth TFT is connected to the first terminal of the ninth TFT and a second terminal of the tenth TFT receives the low potential signal;

one terminal of the first capacitor is connected to the first terminal of the ninth TFT and another terminal of the first capacitor receives the low potential signal;

one terminal of the second capacitor is connected to the third terminal of the seventh TFT and another terminal of the second capacitor is connected to the second terminal of the seventh TFT.

7. The GOA circuit according to claim 3, wherein the GOA unit further comprises a twelfth TFT and an eleventh TFT;

a third terminal of the twelfth TFT is connected to the second terminal of the first TFT and the second terminal of the second TFT, a second terminal of the twelfth TFT receives the low potential signal, and a first terminal of the twelfth TFT is connected to the third terminal of the seventh TFT;

a third terminal and a second terminal of the eleventh TFT are connected together to receive a reset signal, and a first terminal of the eleventh TFT is connected to the third terminal of the seventh TFT.

8. The GOA circuit according to claim 1, wherein all the TFT's in the GOA unit are N-channel TFT's.

9. The GOA circuit according to claim 8, wherein all the clock signals are high potential after power of the liquid crystal display panel is turned off.

10. A GOA circuit, which is used in a liquid crystal display panel, comprising m cascaded GOA units, wherein a $n^{th}$-stage GOA unit comprises: an output control module, a forward-reverse scan control module, a first pull-down circuit, a second pull-down circuit and a pull-up circuit, wherein $m \geq n \geq 1$;

the forward-reverse scan control module is used for controlling the GOA circuit to perform a forward scanning or a reverse scanning in accordance with a forward scan control signal or a reverse scan control signal;

the output control module is connected to the forward-reverse scan control module to output a nth gate driving signal in a duration performing the forward scanning or the reverse scanning by the GOA circuit;

the first pull-down circuit comprises a seventh TFT, a first terminal of the seventh TFT is connected to the output control module, and a second terminal of the seventh TFT receives a low potential signal;

the second pull-down circuit comprises a third TFT, a fourth TFT and a fifth TFT, a first terminal of the third TFT receives the forward scan control signal, a first terminal of the fourth TFT receives the reverse scan control signal, a second terminal of the third TFT and a second terminal of the fourth TFT are connected to a third terminal of the fifth TFT, a third terminal of the third TFT and a third terminal of the fourth TFT receive a clock signal, respectively, and the clock signal turns on the third TFT and the fourth TFT after power of the liquid crystal display panel is turned off;

a first terminal of the fifth TFT receives a high potential signal, and a second terminal of the fifth TFT is connected to a third terminal of the seventh TFT;

the pull-up circuit comprises an eighth TFT and a thirteenth TFT, a first terminal of the eighth TFT is connected to the third terminal of the seventh TFT, a second terminal of the eighth TFT receives the low potential signal, and a third terminal of the eighth TFT receives a first global control signal;

a first terminal and a third terminal of the thirteenth TFT are both connected to the third terminal of the eighth TFT, a second terminal of the thirteenth TFT is connected to the first terminal of the seventh TFT;

the GOA unit further comprises a voltage stabilizing circuit;

the voltage stabilizing circuit comprises a ninth TFT, and the output control module comprises a sixth TFT;

a third terminal of the ninth TFT receives the high potential signal, a second terminal of the ninth TFT is connected to a third terminal of the sixth TFT, a first terminal of the ninth TFT is connected to the forward-reverse scan control module;

a first terminal of the sixth TFT receives a $n^{th}$ clock signal, a second terminal of the sixth TFT is connected to the first terminal of the seventh TFT, and a point connecting the sixth TFT and the seventh TFT is used as an output terminal for outputting the $n^{th}$ gate driving signal;

wherein, the first terminal is one of source and drain, the second terminal is another one of source and drain, the third terminal is gate, and, after power of the liquid crystal display panel is turned off, the forward scan control signal and the reverse scan control signal are both low potential and the first global control signal is high potential.

11. The GOA circuit according to claim 10, wherein the forward-reverse scan control module comprises a first TFT and a second TFT;

a first terminal of the first TFT receives the forward scan control signal, and a second terminal of the first TFT is connected to the first terminal of the ninth TFT;

a first terminal of the second TFT receives the reverse scan control signal, and a second terminal of the second TFT is connected to the second terminal of the first TFT;

wherein, the third terminal of the first TFT receives a $(n-2)^{th}$ gate driving signal when $n>2$, and receives a scan start-up signal when $n \leq 2$;

the third terminal of the second TFT receives a $(n+2)^{th}$ gate driving signal when $n \leq m-2$, and receives the scan start-up signal when $n>m-2$;

the scan start-up signal is high potential after power of the liquid crystal display panel is turned off;

wherein the third terminal of the third TFT receives a $(n+1)^{th}$ clock signal, and the third terminal of the fourth TFT receives a $(n-1)^{th}$ clock signal.

12. The GOA circuit according to claim 11, wherein, the GOA circuit comprises 4 clock signals comprising a first clock signal, a second clock signal, a third clock signal and a fourth clock signal, wherein, the $(n+1)^{th}$ clock signal is the first clock signal when the $n^{th}$ clock signal is the fourth clock signal, and the $(n-1)^{th}$ clock signal is the fourth clock signal when the $n^{th}$ clock signal is the first clock signal.

13. The GOA circuit according to claim 11, wherein the GOA unit further comprises a first capacitor, a second capacitor and a tenth TFT;

a third terminal of the tenth TFT is connected to the second terminal of the fifth TFT, a first terminal of the tenth TFT is connected to the first terminal of the ninth TFT and a second terminal of the tenth TFT receives the low potential signal;

one terminal of the first capacitor is connected to the first terminal of the ninth TFT and another terminal of the first capacitor receives the low potential signal;

one terminal of the second capacitor is connected to the third terminal of the seventh TFT and another terminal of the second capacitor is connected to the second terminal of the seventh TFT.

14. The GOA circuit according to claim 11, wherein the GOA unit further comprises a twelfth TFT and an eleventh TFT;

a third terminal of the twelfth TFT is connected to the second terminal of the first TFT and the second terminal of the second TFT, a second terminal of the twelfth TFT receives the low potential signal, and a first terminal of the twelfth TFT is connected to the third terminal of the seventh TFT;

a third terminal and a second terminal of the eleventh TFT are connected together to receive a reset signal, and a first terminal of the eleventh TFT is connected to the third terminal of the seventh TFT.

15. The GOA circuit according to claim 10, wherein all the TFT's in the GOA unit are N-channel TFT's.

16. The GOA circuit according to claim 15, wherein all the clock signals are high potential after power of the liquid crystal display panel is turned off.

* * * * *